US008303280B2

(12) United States Patent
Kiyokawa et al.

(10) Patent No.: US 8,303,280 B2
(45) Date of Patent: Nov. 6, 2012

(54) SCROLL TYPE COMPRESSOR COMPRISING AN OLDHAM RING HAVING A REINFORCED PAWLS AND A MIRROR PLATE HAVING A CONCAVE RECESS FOR A MOVABLE SCROLL

(75) Inventors: Yasunori Kiyokawa, Moriguchi (JP); Yoshiaki Koike, Moriguchi (JP); Kazuyoshi Sugimoto, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 374 days.

(21) Appl. No.: 12/709,089

(22) Filed: Feb. 19, 2010

(65) Prior Publication Data

US 2010/0215536 A1 Aug. 26, 2010

(30) Foreign Application Priority Data

Feb. 20, 2009 (JP) ..... 2009-037382

(51) Int. Cl.
*F03C 4/00* (2006.01)
*F04C 18/00* (2006.01)

(52) U.S. Cl. ..... 418/55.3; 418/55.1; 464/102

(58) Field of Classification Search ..... 418/55.1–55.6, 418/57; 464/102–104
See application file for complete search history.

(56) References Cited

U.S. PATENT DOCUMENTS 4,795,323 A * 1/1989 Lessie ..... 418/55.3
5,735,677 A * 4/1998 Miura et al. ..... 418/55.2
6,106,252 A * 8/2000 Yamanaka et al. ..... 418/55.3

FOREIGN PATENT DOCUMENTS

JP 2000-283067 10/2000
JP 2003065257 A * 3/2003
JP 2006-161818 6/2006
KR 2005028214 A * 3/2005

* cited by examiner

*Primary Examiner* — Theresa Trieu
(74) *Attorney, Agent, or Firm* — McDermott Will & Emery LLP

(57) ABSTRACT

In a scroll type compressor including a fixed scroll having a mirror plate and a lap provided to the mirror plate, a movable scroll having a mirror plate and a lap provided to the mirror plate and engaged with the fixed scroll, and an Oldham's ring disposed on the back side of the movable scroll for constraining rotation of the movable scroll on the axis thereof, the Oldham's ring has a pair of fixing locking pawls extending from the back side of the movable scroll and fitted to the fixed scroll, each of the fixing locking pawls is provided with a reinforcing portion at the base portion thereof, and the mirror plate of the movable scroll is cut out in a concave shape at the edge portion thereof in conformity with a movement range of the reinforcing portion to form a concaved escape portion at the edge portion of the mirror plate.

5 Claims, 6 Drawing Sheets

SCROLL TYPE COMPRESSOR COMPRISING AN OLDHAM RING HAVING A REINFORCED PAWLS AND A MIRROR PLATE HAVING A CONCAVE RECESS FOR A MOVABLE SCROLL

INCORPORATION BY REFERENCE

The present application claims priority under 35 U.S.C. §119 to Japanese Patent Application No. 2009-037382 filed on Feb. 20, 2009. The content of the application is incorporated herein by reference in its entirety.

BACKGROUND OF THE INVENTION

1. Field of the Invention

The present invention relates to a scroll type compressor for performing compression through the engagement between a fixed scroll and a movable scroll.

2. Description of the Related Art

In general, there is known a scroll type compressor that includes a fixed scroll and a movable scroll engaged with the fixed scroll, the fixed scroll and the movable scroll being accommodated in a hermetically sealed container, and compresses gas by rotating the movable scroll. The movable scroll is supported through an Oldham's ring by a housing (which is also called as a compliant frame. The Oldham's ring is a member for constraining the movable scroll so that the movable scroll makes a whirling motion, and a fitting pawl for fixing (fixing key) is fitted in a groove provided in the housing, whereby the Oldham's ring is fixed to the housing.

A recently known scroll type compressor is configured so that the Oldham's ring is not fixed to the housing, but fixed to the fixed scroll in order to enhance the assembling precision concerning the positioning (phase) of the fixed scroll and the movable scroll. In this structure, the fixing locking pawl extending from the Oldham's ring extends beyond the movable scroll and is fitted to the fixed scroll (see JP-A-2006-161818 and JP-A-2000-283067, for example).

However, in the above structure, the fixing locking pawl of the Oldham's ring is longer, and thus the fixing locking pawl is easily broken.

Furthermore, the movable scroll is located between the Oldham's ring and the fixed scroll, and thus the movable scroll is provided with an escape portion which avoids the fixing locking pawl extending from the Oldham's ring. However, when a chuck is fixed to the movable scroll to perform working, this escape portion obstructs this chuck fixing work.

Specifically, as show in FIG. 6, the movable scroll 125 is constructed by providing a lap 125B is provided to a circular mirror plate 125A. A pair of guide grooves for receiving and guiding a projecting portion provided to the Oldham's ring are formed in the mirror plate 125A so as to be displaced in phase by 180°, and right and left circumferential portions of the mirror plate 125A are cut out in parallel to the guide direction of the guide grooves 190, thereby forming escape portions 191. The processing of the lap, etc. of the movable scroll 125 is performed while three points Q1 to Q3 of the outer periphery of the mirror plate 125A which are respectively displaced in phase by 120° are gripped by a three-point chuck which is normally used in a machine work. However, when the three-chuck is secured to the outer periphery of the mirror plate 125A while avoiding the guide grooves 190 under the state of FIG. 6, any one of the points Q1 and Q3 invades into the escape portion 191, and thus the chuck can not be secured to the mirror plate 125A with avoiding the guide groove 190, which causes reduction in processing accuracy and processing efficiency.

SUMMARY OF THE INVENTION

The present invention has been implemented in view of the foregoing situation, and has an object to provide a scroll type compressor that is excellent in strength of Oldham's ring and processing performance.

In order to attain the above object, according to the present invention, in a scroll type compressor including a fixed scroll having a mirror plate and a lap provided to the mirror plate, a movable scroll 25 having a mirror plate and a lap that is provided to the mirror plate and engaged with the fixed scroll, and an Oldham's ring that is disposed on the back side of the movable scroll and constrains rotation of the movable scroll on the axis thereof, the Oldham's ring has a pair of fixing locking pawls extending from the back side of the movable scroll and fitted to the fixed scroll, each of the fixing locking pawls is provided with a reinforcing portion at the base portion thereof, and the mirror plate of the movable scroll is cut out in a concave shape at the edge portion thereof in conformity with a movement range of the reinforcing portion to form a concaved escape portion at the edge portion of the mirror plate.

According to the above scroll type compressor, the reinforcing portion is provided to the base portion of the fixing locking pawl of the Oldham's ring, and thus the strength of the fixing locking pawl is enhanced, so that the fixing locking pawl is hardly broken.

Furthermore, the edge portion of the movable scroll is cut out in a concaved shape to form the escape portion for the fixing locking pawl. Therefore, the cut-out amount of the edge portion can be made smaller as compared with the prior art. Accordingly, the edge portion of the movable scroll can be left to the extent that a generally available three-point chuck can be secured to the movable scroll. Therefore, the processing using the three-point chuck can be performed.

In the above scroll type compressor, both the side surfaces (91A) of the concaved cut-out constituting the escape portion may be shaped so as to be fitted to the reinforcing portion. According to the above scroll type compressor, the width of the escape portion can be suppressed to the minimum level required for the movement of the reinforcing portion. Therefore, the cut-out amount of the edge portion of the mirror plate of the movable scroll can be made further smaller.

In the above scroll type compressor, the reinforcing portion is larger in width than the fixing locking pawl in a predetermined direction. According to the above scroll type compressor, the fixing locking pawl of the Oldham's ring can be further strengthened.

According to the present invention, the reinforcing portion is provided to the base portion of the fixing locking pawl of the Oldham's ring, and thus the strength of the fixing locking pawl is enhanced, so that the fixing locking pawl is hardly broken. Furthermore, the edge portion of the movable scroll is cut out in a concaved shape to form the escape portion for the fixing locking pawl. Therefore, the cut-out amount of the edge portion can be made smaller as compared with the prior art. Accordingly, the edge portion of the movable scroll can be left to the extent that a generally available three-point chuck can be secured to the movable scroll. Therefore, the three-point chuck can be easily secured to the movable scroll.

DETAILED DESCRIPTION OF THE PREFERRED EMBODIMENT

A preferred embodiment according to the present invention will be described with reference to the accompanying drawings.

Figure 1:
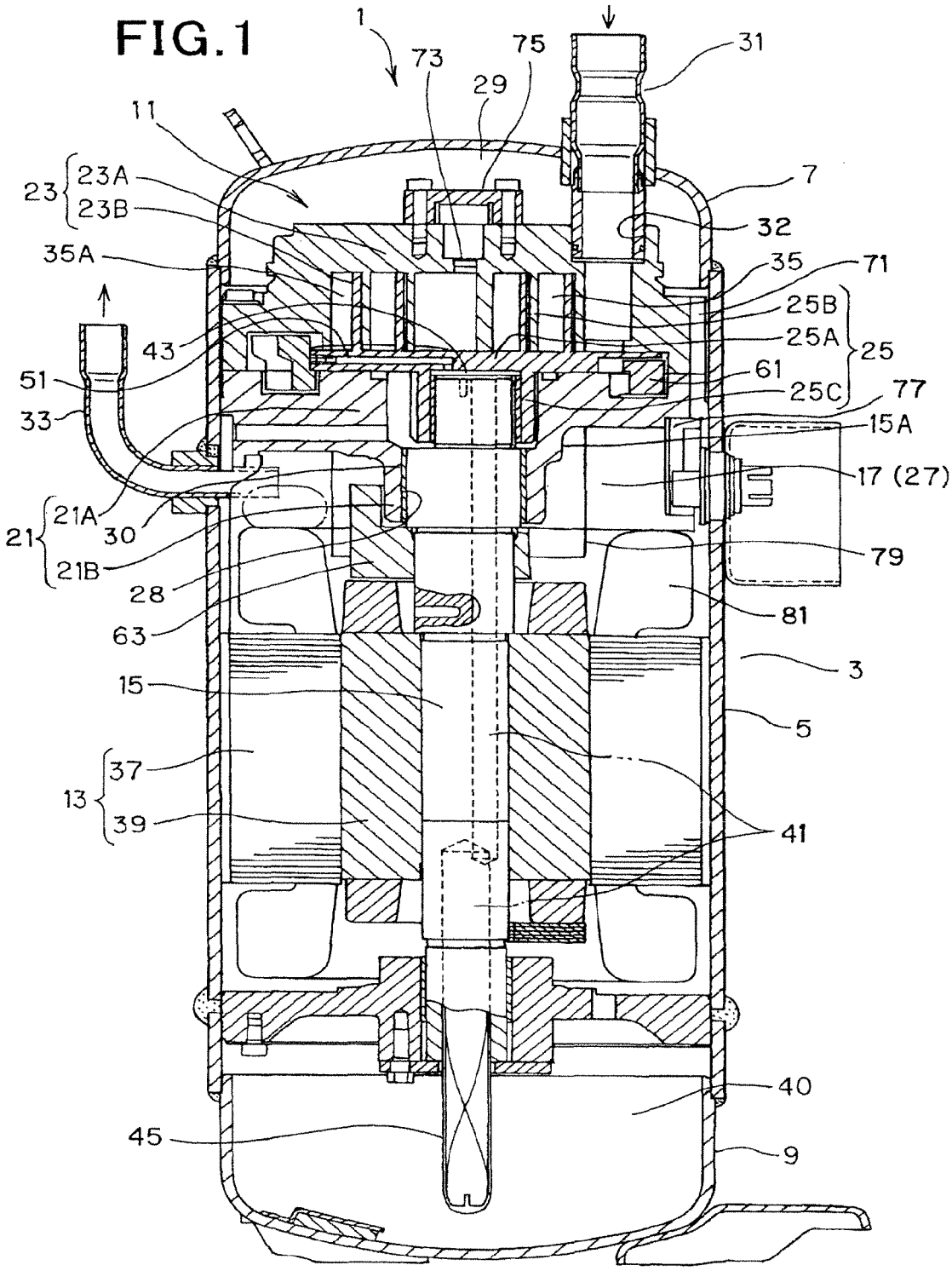
FIG. 1 is a cross-sectional view showing a scroll type compressor according to an embodiment of the present invention.

In FIG. 1, reference numeral 1 represents a scroll type compressor having a high internal pressure. The compressor 1 is connected to a refrigerant circuit (not shown) in which refrigerant is circulated to perform a refrigeration cycle operation, and compresses the refrigerant. The compressor 1 has a hermetically-sealed dome type casing 3 which is designed in an elongated cylindrical shape.

The casing 3 is constructed as a pressure container by a casing main body 5 as a cylindrical body portion having an axis line in the up-and-down direction, a saucer-shaped upper cap 7 which is air-tightly welded and integrally joined to the upper end portion of the casing main body 5 and has an upwardly projecting convex surface, and a saucer-shaped lower cap 7 having a downwardly projecting convex surface, and the inside of the casing 3 is designed to have a cavity.

A scroll compression mechanism 11 for compressing refrigerant, and a driving motor 13 disposed below the scroll compression mechanism 11 are mounted in the casing 3. The scroll compression mechanism 11 and he driving motor 13 are connected to each other through a driving shaft 15 which is disposed so as to extend in the up-and-down direction in the casing 3. A gap space 17 is formed between the scroll compression mechanism 11 and the driving motor 13.

The scroll compression mechanism 11 has a housing 21 as a substantially cylindrical accommodating member which is opened at the upper side thereof and has a bottom, a fixed scroll 23 which is disposed in close contact with the upper surface of the housing 21, and a movable scroll 25 which is disposed between the fixed scroll 23 and the housing 21 and engaged with the fixed scroll 23. The housing 21 is press-fitted in the casing main body 5 over the whole outer peripheral surface thereof in the peripheral direction. The inside of the casing 3 is compartmented into a high pressure space 27 at the lower side of the housing 21 and a discharge space 29 at the upper side of the housing 21, and the respective spaces 27 and 29 intercommunicate with each other through a longitudinal groove (passage) 71 which is formed on the outer peripheries of the housing 21 and the fixed scroll 23 so as to extend longitudinally.

The housing 21 is provided with a housing space 21A in which an eccentric axial portion 15A of the driving shaft 15 is rotated, and a radial bearing portion 21B extending downwardly from the center of the lower surface of the housing 21. Furthermore, the housing 21 is provided with a radial bearing hole 28 penetrating between the lower end surface of the radial bearing portion 21B and the bottom surface of the housing space 21A, and the upper end portion of the driving shaft 15 is rotatably fitted and mounted through the radial bearing 30 in the radial bearing hole 28. A suction pipe 31 for leading the refrigerant in the refrigerant circuit to the scroll compression mechanism 11 penetrates through the upper cap 7 of the casing 3 and is air-tightly fixed to the upper cap 7, and a discharge pipe 33 for discharging the refrigerant in the casing 3 to the outside of the casing 3 penetrates through the casing main body 5 and is air-tightly fixed to the casing main body 5. The suction pipe 31 extends in the up-and-down direction in the discharge space 29, and the inner end portion of the suction pipe 31 penetrates through a suction port 32 opened to the fixed scroll 23 of the scroll compression mechanism 11, and intercommunicates with the compression chamber 35. Accordingly, the refrigerant is sucked into the compression chamber 35 through the suction pipe 31.

The driving motor 13 has an annular stator 37 fixed to the inner wall surface of the casing 3, and a rotor 39 which is freely rotatably provided inside the stator 37, the motor 13 is constructed by a DC motor, and the movable scroll 25 of the scroll compression mechanism 11 is connected to the rotor 39 through the driving shaft 15.

The lower space 40 at the lower side of the driving motor 13 is kept to a high-pressure state, and oil is stocked at the inner bottom portion of the lower cap 9 corresponding to the lower end portion of the lower space 40. An oil supply path 41 as a part of a high-pressure oil supply unit is formed in the driving shaft 15, the oil supply path 41 intercommunicates with an oil chamber 43 at the back side of the movable scroll 25. A pickup 45 is connected to the lower end of the driving shaft 15, and the pickup 45 scoops up the oil stocked at the inner bottom portion of the lower cap 9. The scooped oil is passed through the oil supply path 41 of the driving shaft 15 and supplied to the oil chamber 43 at the back side of the movable scroll 25, and supplied from the oil chamber 43 to each sliding portion and the compression chamber 35 of the scroll compression mechanism 11 through an intercommunication path 51 provided to the movable scroll 25.

The fixed scroll 23 comprises a mirror plate 23A and a scroll-like (involute type) lap 23*b* formed on the lower surface of the mirror plate 23A. The movable scroll 25 comprises a mirror plate 25A and a scroll-type (involute type) lap 25B formed on the upper surface of the mirror plate 25A. The lap 23B of the fixed scroll 23 and the lap 25B of the movable scroll 25 are engaged with each other, whereby plural compression chambers 35 are formed by both the laps 23B and 25B between the fixed scroll 23 and the movable scroll 25.

The movable scroll 25 is supported through the Oldham's ring 61 by the fixed scroll 23, and a cylindrical boss portion 25C having a bottom is projected from the center portion of the lower surface of the mirror plate 25A. Furthermore, an eccentric shaft portion 15A is provided to the upper end of the driving shaft 15, and the eccentric shaft portion 15A is rotatably fitted in the boss portion 25C of the movable scroll 25.

Furthermore, a counter weight portion 63 is provided to the driving shaft 15 at the lower side of the radial bearing portion 21B of the housing 21 in order to establish dynamic balance with the movable scroll 25, the eccentric shaft portion 15A, etc. The driving shaft 15 rotates while keeping the weight balance by the counter weight portion 63, whereby the movable scroll 25 does not rotate on its axis, but swirls. the compression chamber 35 is configured so that in connection with the swirling of the movable scroll 25, the refrigerant sucked by the suction pipe 31 is compressed due to contraction of the volume between both the laps 23B and 25B.

A discharge hole 73 is provided at the center portion of the fixed scroll 23, and gas refrigerant discharged from the discharge hole 73 is passed through the discharge valve 75 and discharged to the discharge space 29, and flows out into the high-pressure space 27 at the lower side of the housing 21 through a longitudinal groove 71 formed on the respective outer peripheries of the housing 21 and the fixed scroll 23. This high-pressure refrigerant is discharged to the outside of the casing 3 through the discharge pipe 33 provided to the casing main body 5.

A guide member (gas flow deflecting member) 77 is provided to the lower side of the longitudinal groove 71. The guide member 77 deflects the flow direction of the gas refrigerant (which is discharged from the discharge valve 75 to the discharge space 29, passed through the longitudinal groove 71 and flows downwardly) toward a shielding plate 79 and/or in the horizontal direction along the inner surface of the casing main body 5 (casing 3), and also guides the gas refrigerant through a passage between the shielding plate 79 at the upper side of the coil end 81 of the driving motor 13 and the inner surface of the casing main body 5 (casing 3) and then to the discharge pipe 33.

The driving operation of the scroll type compressor 1 described above will be described.

When the driving motor 13 is driven, the rotor 39 rotates relative to the stator 37, and thus the driving shaft 15 rotates. When the driving shaft 15 rotates, the movable scroll 25 of the scroll compression mechanism 11 does not rotate on its axis, but makes only the swirling motion relative to the fixed scroll 23. Accordingly, low-pressure refrigerant is passed through the suction pipe 31, and sucked from the peripheral edge side of the compression chamber 35 into the compression chamber 35, so that this refrigerant is compressed in connection with volume variation of the compression chamber 35. The compressed refrigerant is increased in pressure, passed from the compression chamber 35 to the discharge valve 75, and discharged to the discharge space 29. Further, the refrigerant is passed through the longitudinal groove 71 formed on the respective outer peripheries of the housing 21 and the fixed scroll 23, and then flows out to the high-pressure space at the lower side of the housing 21. Still further, this high-pressure refrigerant is discharged through the discharge pipe 33 provided to the casing main body 5 to the outside of the casing 3. After the refrigerant discharged to the outside of the casing 3 is circulated in the refrigerant circuit (not shown), the refrigerant is sucked through the suction pipe 31 into the compressor 1 again, and compressed in the compressor. The circulation of the refrigerant as described above is repeated.

Figure 2:
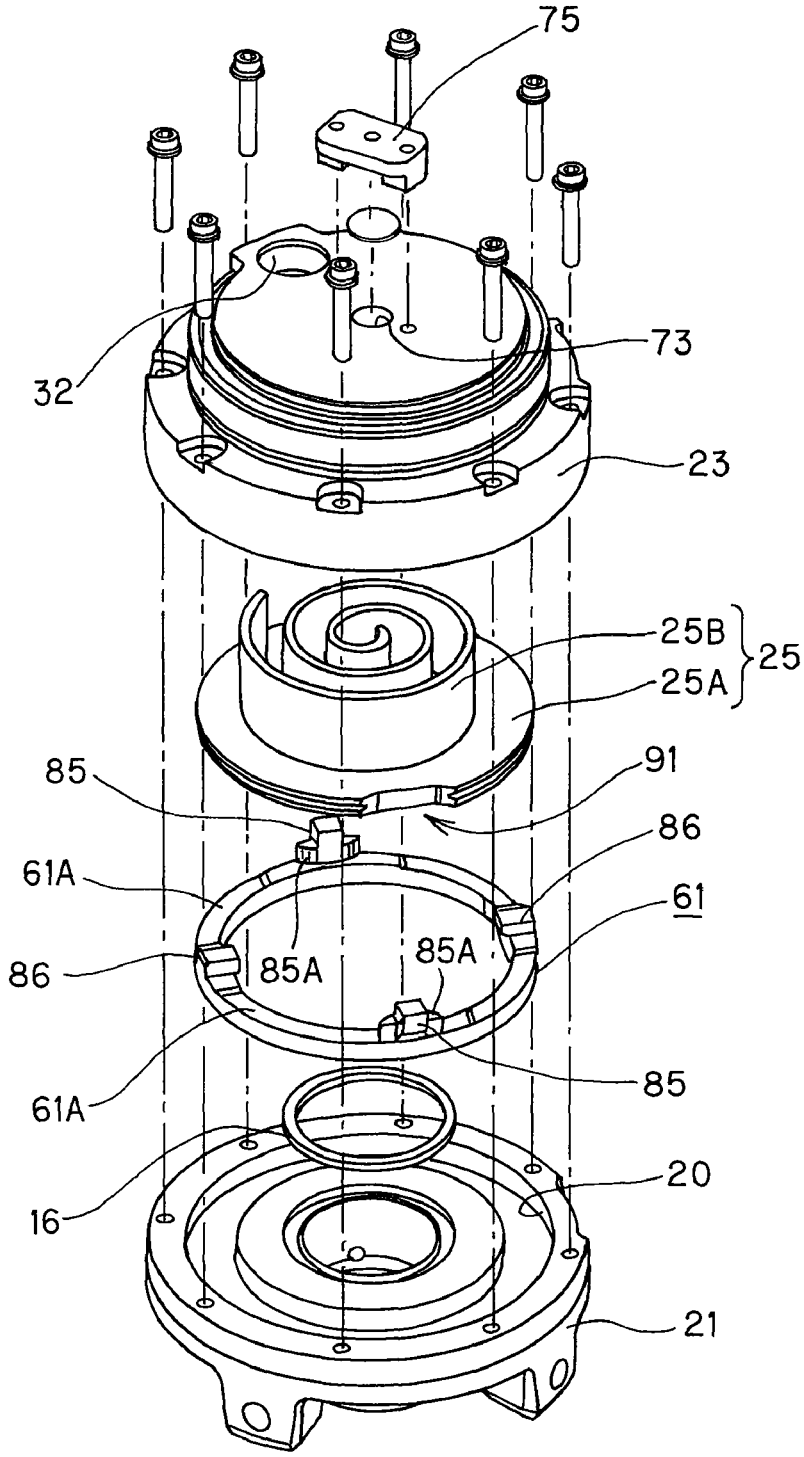
FIG. 2 is an exploded diagram showing a movable scroll and a fixed scroll of a scroll compression mechanism.
Figure 3:
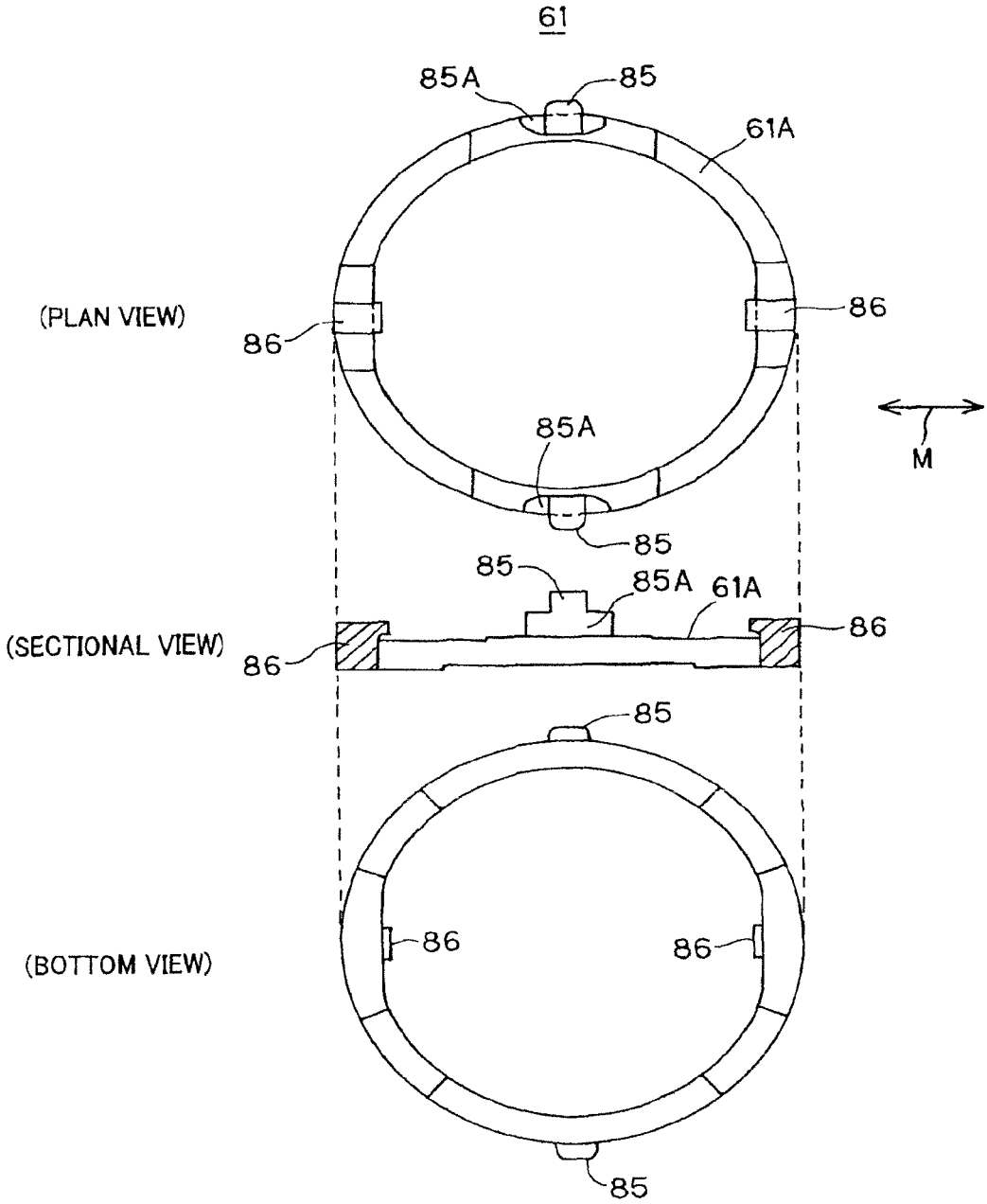
FIG. 3 is plan, cross-sectional and bottom views of an Oldham's ring.
Figure 4:
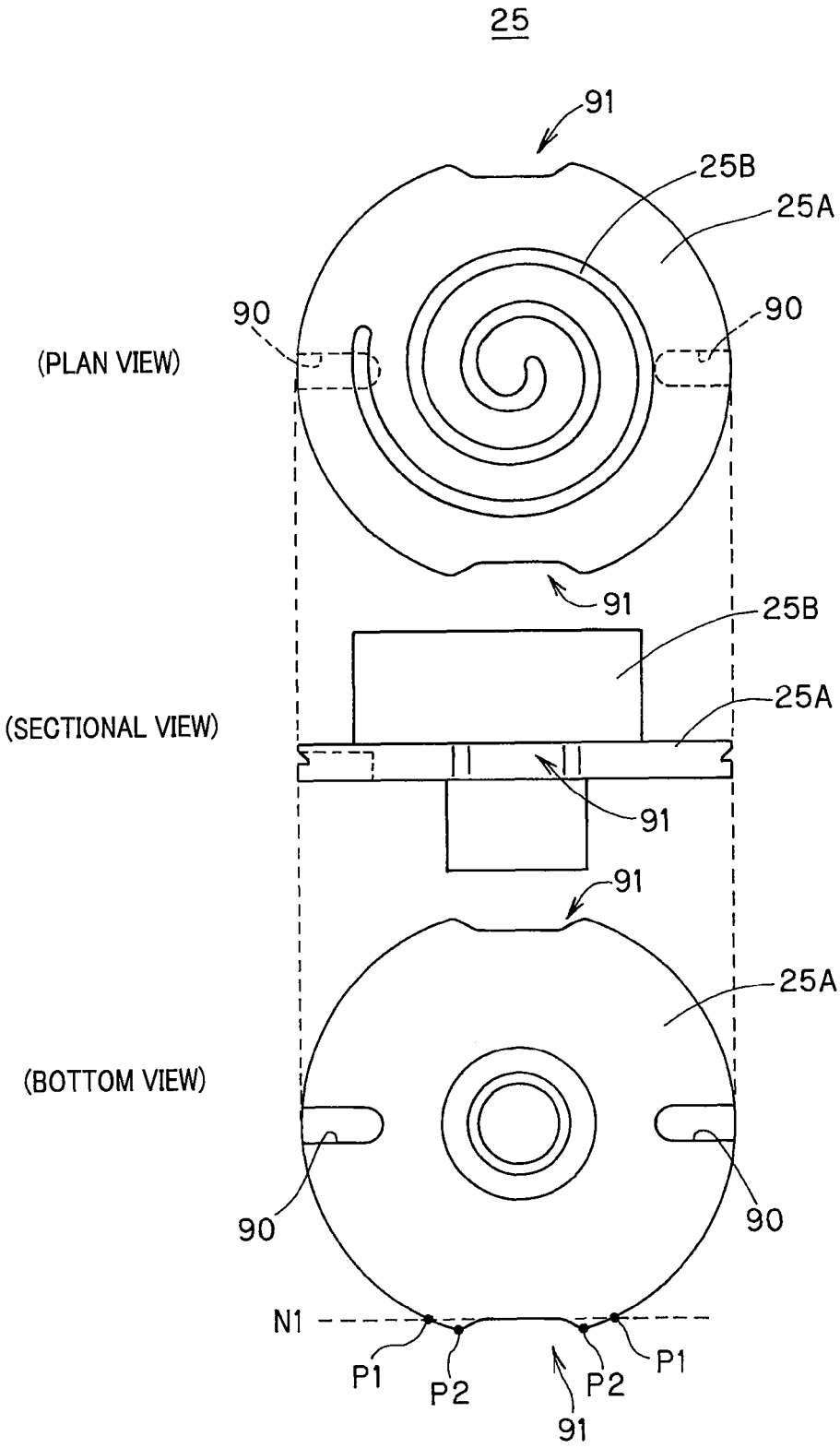
FIG. 4 is plan, side and bottom views of the movable scroll.

FIG. 2 is an exploded diagram of the movable scroll 25 and the fixed scroll 23 of the scroll compression mechanism 11, and FIG. 3 is plan, side and bottom views of the Oldham's ring 61. FIG. 4 is plan, side and bottom views of the movable scroll 25. In FIG. 2, reference numeral 16 represents a seal ring.

As described above, the movable scroll 25 is supported through the Oldham's ring 61 in the housing 21. The Oldham's ring 61 is a member for constraining the rotation of the movable scroll 25 on its axis and swirling the movable scroll 25. The Oldham's ring 61 is fitted in the ring groove 20 formed on the upper surface of the housing 21, and the back surface of the movable scroll 25 is disposed in close contact with the upper surface 61A of the Oldham's ring 61.

A pair of fixing locking pawls 85 which are provided to be displaced in phase by 180° and a pair of projecting portions 86 which are provided to be displaced in phase by 180° are provided on the upper surface 61A of the Oldham's ring 61.

The fixing locking pawls 85 projects so as to extend from the upper surface 61A beyond the movable scroll 25 and reach the fixed scroll 23, and it is fitted to the fixed scroll 23. As described above, the fixing locking pawl 85 is fitted to the fixed scroll 23, whereby the Oldham's ring 61 is fixed in the casing 3.

The projecting portion 86 is a member for constraining the rotation of the movable scroll which is rotated between the Oldham' ring 61 and the fixed scroll 23, but swirling the movable scroll 25.

More specifically, the movable scroll 25 has a substantially circular mirror plate 25A, and a lap 25B provided to the upper surface of the mirror plate 25A. A pair of guide grooves 90 to which the projecting portions 86 of the Oldham's ring 61 are fitted are formed at the bottom surface side of the mirror plate 25A, and the escape portions 91 for avoiding the fixing locking pawls 85 are formed on the circumference of the mirror plate 25A. The projections 86 of the Oldham's ring are fitted in the guide grooves 90, whereby the movable scroll 25 is constrained from rotating on its axis when it is rotationally driven.

As described above, the movable scroll 25 relatively moves between the Oldham's ring 61 and the fixed scroll 23. Therefore, a load is imposed on the Oldham's ring 61 which regulates the movement of the movable scroll 25, and particularly an extremely large load is imposed on the fixing locking pawls 85 for fixing the Oldham's ring 61. Furthermore, according to this embodiment, the Oldham's ring 61 is formed by aluminum die-casting, and thus the strength of the fixing locking pawl 85 is a critical problem.

Therefore, in this embodiment, a reinforcing portion 85A is formed at the base of the fixing locking pawl 85 to reinforce the strength of the fixing locking pawl 85. The reinforcing portion 85A is designed in a pedestal-like shape to be thicker than the fixing locking pawl 85, and the strength of the fixing locking pawl 85 is reinforced by providing the reinforcing portion 85A as described above.

As shown in FIG. 3, the reinforcing portion 85A is designed to be larger in width than the fixing locking pawl 85 in the guide direction M of the projecting portions 86, whereby the fixing locking pawl 85 has high strength with respect to an impact when the movable scroll 25 is driven.

Furthermore, the escape portion 91 is formed at the edge portion of the mirror plate 25A of the movable scroll 25 in conformity with a moving range of each reinforcing portion 85A, that is, so as to avoid the movement range of each reinforcing portion 85A. As shown in FIG. 4, each of the escape portions 91 is not formed by simply cutting out the circumference of the edge portion of the mirror plate 25A along a line N1 extending along the movement direction of the reinforcing portion 85A, but formed by a concaved notch. Accordingly, when the intersecting point between the circumference of the mirror plate 25A and the line N1 is represented by P1 and the ends of the opening of the concaved escape portion 91 are represented by P2, the circumference of the mirror plate 25A is extended by the amount corresponding to the total length of the circular arcs between the points P1 and P2. Accordingly, the three-point chuck can be secured to the movable scroll 25 at three gripping positions which avoid the escape portions 91 and the guide grooves 90 and also are displaced in phase by 120°.

Figure 5:
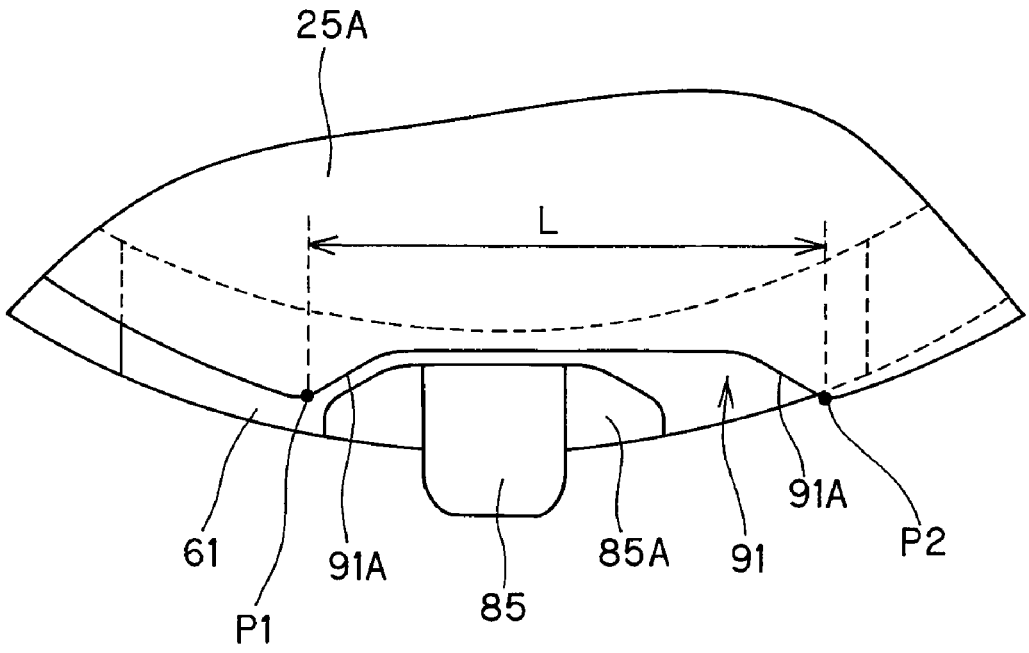
FIG. 5 is a diagram showing an engagement structure between an escape portion of the movable scroll and a reinforced portion of the Oldham's ring.
Figure 6:
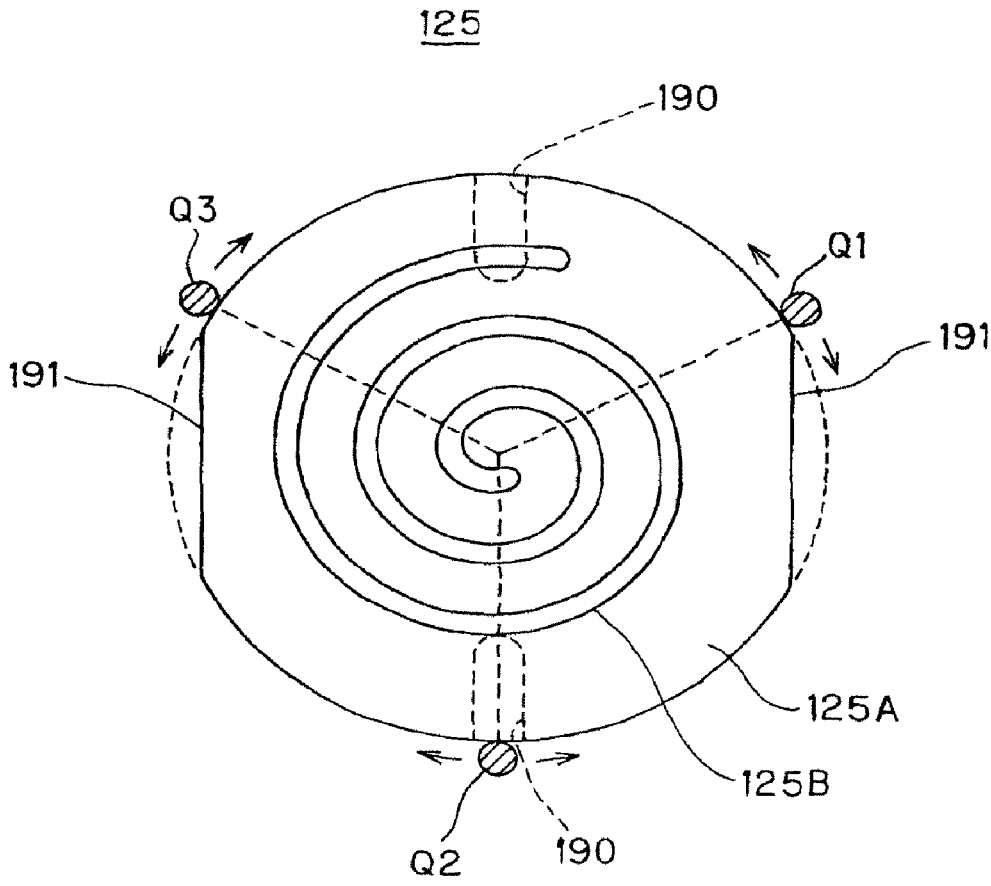
FIG.6 RELATED ART
FIG. 6 is a diagram showing an escape portion of a conventional movable scroll.

As shown in FIG. 5, both the side surfaces 91A of the concave notch constituting the escape portion 91 are designed to be matched with the shape of the reinforcing portion 85A and also fitted to the reinforcing portion 85A. Accordingly, the lateral width L of the escape portion 91 is suppressed to the minimum level required for the movement of the reinforcing portion 85A which is designed to sufficiently reinforce the strength of the fixing locking pawl 85. Therefore, the cut-out amount of the circumference (edge portion) of the mirror plate 25A can be suppressed to the minimum level. Accordingly, both the reinforcement of the strength of the fixing locking pawl 85 and also the securement of the gripping positions of the three-point chuck can be performed.

Both the end portions of the reinforcing portion 85A is shaped to have a predetermined curvature, and thus the escape portions 91 can be simply formed by slice processing.

As described above, according to this embodiment, the reinforcing portion 85A is provided to the base of the fixing locking pawl 85 of the Oldham's ring 61, and thus the strength is enhanced, so that the fixing locking pawl 85 is hardly broken.

In addition, the escape portions 91 are formed by cutting out the circumference of the mirror plate 25 in a concave shape, and thus the cut-out amount of the circumference of the mirror plate 25A can be reduced as compared with the prior art. Accordingly, a generally available three-point chuck can be secured to grip positions which avoid the escape portions 91 and the guide grooves 90, and under this state, the lap 25B, etc. can be excellently processed.

Furthermore, according to this embodiment, both the side surfaces 91A of each escape portion 91 are designed to be fitted to the reinforcing portion 85A, and thus the width L of the escape portion 91 can be suppressed to the minimum level required for the movement of the reinforcing portion 85A, and thus the cut-out amount of the edge portion of the mirror plate of the movable scroll can be made smaller.

Accordingly, both the reinforcement of the strength of the fixing locking pawl 85 and the securement of the gripping positions of the three-point chuck can be performed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the skilled in the art to understand the invention for various embodiments and with the various modifications as are suited to the particular use contemplated. It is intended that the scope of the invention be defined by the following claims and their equivalents.

What is claimed is:

1. A scroll type compressor comprising:

a fixed scroll;

a movable scroll having a mirror plate and a lap that is provided to the mirror plate and engaged with the fixed scroll; and an Oldham's ring that is disposed on a back side of the movable scroll and constrains rotation of the movable scroll on an axis thereof, wherein:

the Oldham's ring has a pair of fixing locking pawls extending toward the fixed scroll and configured to fix the movable scroll from a back side of the movable scroll by being fitted to the fixed scroll, and a pair of projecting portions for constraining the rotation of the movable scroll, each of the fixing locking pawls is provided with a reinforcing portion at a base portion thereof, the mirror plate of the movable scroll is cut out in a concave shape at an edge portion thereof in conformity with a movement range of the reinforcing portion to form a air of concaved escape portions at the edge portion of the mirror plate, the mirror plate is provided with a pair of guide grooves to which the pair of projecting portions are respectively fitted, and the pair of concaved escape portions and the pair of guide grooves are provided so that three points displaced in phase by 120° are all disposed on the edge portion of the mirror plate except for the pair of concaved escape portions and the pair of guide grooves.

2. The scroll type compressor according to claim 1, wherein both side surfaces of each of the pair of concaved escape portions are shaped so as to be fitted to the reinforcing portion.

3. The scroll type compressor according to claim 1, wherein the reinforcing portion is larger in width than the fixing locking pawl in a predetermined direction.

4. The scroll type compressor according to claim 1, wherein:

the pair of concave escape portions are displaced in phase by 180° and the pair of projecting portions are displaced in phase by 180°, and the pair of concave escape portions and the pair of projecting portions are displaced in phase by 90°.

5. A scroll type compressor comprising:

a fixed scroll;

a movable scroll including a mirror plate; and an Oldham's ring for constraining rotation of the movable scroll on an axis thereof and for fixing the movable scroll to the fixed scroll, wherein:

the Oldham's ring has a pair of fixing locking pawls extending toward the fixed scroll and configured to fix the movable scroll from a back side of the movable scroll by being fitted to the fixed scroll, and a pair of projecting portions for constraining the rotation of the movable scroll, the mirror plate of the movable scroll is cut out in a concave shape at an edge portion thereof in conformity with a movement range of the pair of fixing locking pawls to form a pair of concaved escape portions at the edge portion of the mirror plate, the mirror plate is provided with a pair of guide grooves to which the pair of projecting portions are respectively fitted, and the pair of concaved escape portions and the pair of guide grooves are provided so that three points displaced in phase by 120° are all disposed on the edge portion of the mirror plate except for the pair of concaved escape portions and the pair of guide grooves.

* * * * *